United States Patent [19]

Epler et al.

[11] Patent Number: 5,039,357

[45] Date of Patent: Aug. 13, 1991

[54] METHOD FOR NITRIDING AND NITROCARBURIZING RIFLE BARRELS IN A FLUIDIZED BED FURNACE

[75] Inventors: Loren Epler, Rochester Hills; Dennis Manier, Southfield, both of Mich.

[73] Assignee: Dynamic Metal Treating, Inc., Canton Township, Wayne County, Mich.

[21] Appl. No.: 538,565

[22] Filed: Jun. 15, 1990

[51] Int. Cl.[5] ..... C21D 1/74

[52] U.S. Cl. ..... 148/16.6; 148/14; 148/16; 148/150; 148/156

[58] Field of Search ..... 148/13, 14, 16, 16.6, 148/150, 156

[56] References Cited

U.S. PATENT DOCUMENTS

| | | | |
|---|---|---|---|
| 2,541,116 | 2/1951 | Somes | 148/150 |
| 2,596,981 | 4/1952 | Chenault et al. | 148/16.6 |
| 2,789,930 | 4/1957 | Engelhard | 148/16.6 |
| 2,799,959 | 7/1957 | Osborn | 148/16.6 |
| 3,130,671 | 4/1964 | Berghaus | 148/16.6 |
| 4,221,972 | 9/1980 | Oppel et al. | 148/16.6 |
| 4,410,373 | 10/1983 | Kemp | 148/16 |
| 4,461,656 | 7/1984 | Ross | 148/16.6 |
| 4,511,411 | 4/1985 | Brunner et al. | 148/16.6 |
| 4,512,821 | 4/1985 | Staffin et al. | 148/16.6 |
| 4,713,122 | 12/1987 | Dawes et al. | 148/16.6 |
| 4,793,871 | 12/1988 | Dawes et al. | 148/16.6 |
| 4,871,401 | 10/1989 | Arai et al. | 148/16.6 |

*Primary Examiner*—Upendra Roy

*Attorney, Agent, or Firm*—Remy J. VanOphem

[57] ABSTRACT

A method for nitriding and nitrocarburizing the bores of rifle barrels or similar elongated hollow objects in which a funnel is attached to the inlet end of each of rifle barrel prior to treatment. The rifle barrels are then loaded into a fluidized bed furnace in a substantially vertical position with the open end of the funnel facing the direction of flow of the reactant gases and fluidized particulate medium through the fluidized bed furnace. When the rifle barrels are submerged in the fluidized particulate medium, the rifle barrels are heated to a reaction temperature for a predetermined period of time. The funnels increase the quantity of reactant gases and fluidized particulate medium flowing through the bore of each rifle barrel. As a result, excellent nitrided and nitrocarburized surfaces have been obtained in the bores of rifle barrels made from ferrous and titanium alloys at reduced processing temperatures and times.

24 Claims, 1 Drawing Sheet

METHOD FOR NITRIDING AND NITROCARBURIZING RIFLE BARRELS IN A FLUIDIZED BED FURNACE

BACKGROUND OF THE INVENTION

1. Field of the Invention

The invention is related to the field of hardening the bores of rifle barrels and in particular to forming nitrided and nitrocarburized surfaces in the bores of rifle barrels using a fluidized bed furnace.

2. Description of the Prior Art

The hardening of the internal surfaces or bores of rifle barrels, gun barrels and cannons is well known in the art. These hardened surfaces reduce friction and wear of the bore increasing the accuracy and life of the rifles and gun barrels. The bores of the rifles may be hardened by heat treatment followed by a rapid quenching as taught by Somes in U.S. Pat. No. 2,541,114 or Polcha in U.S. Pat. No. 3,780,465. Alternatively, the bores of the rifles or guns may be hardened by nitriding as taught by Chenault et al in U.S. Pat. No. 2,596,981 and Osborn in U.S. Pat. No. 2,799,959. Chenault et al teach nitriding at a temperature of approximately 1000° F. at a pressure of 100 atmospheres for approximately 15 hours while Osborn teaches nitriding at a temperature of 950° F. to 975° F. for 38 hours. Siemers et al, in U.S. Pat. No. 4,577,431, and Gstettner et al, in U.S. Pat. No. 4,747,225, disclose the application of a hard material over the internal surface of the rifle's bore. Siemers et al disclose coating the bore with a layer of refractory metal such as tantalum alloy by means of a vacuum plasma spray while Gstettner et al teach sintering of a thin heat resistant nickel based alloy on the surface of the bore. The use of a fluidized bed furnace for nitriding or nitrocarburizing various metals is taught by Ross in U.S. Pat. No. 4,461,656 and Staffin et al in U.S. Pat. No. 4,512,821. Ross teaches the treatment of ferrous metal components in a particulate medium fluidized with ammonia gas, a hydrocarbon gas, and nitrogen gas while Staffin et al teach the use of an atmosphere precursor, such as methanol or ethyl acetate in the fluidized bed furnace to produce the desired atmosphere.

In their paper "Nitriding of Titanium with Ammonia" presented before the Thirty-fifth Annual Convention of the American Society of Metallurgy, held Oct. 17 through 23, 1953, and published in the Transactions of ASM, Volume 46, 1954, pp. 191 through 218, James L. Wyatt and Nicholas J. Grant presented a detailed process for nitriding titanium and titanium alloys by the decomposition of ammonia at elevated temperatures.

The direct application of the methods taught by Ross and Wyatt et al to steel and aluminum alloy rifle barrels using a fluidized bed furnace failed to produce satisfactory nitrided or nitrocarburized surfaces within the bores of these rifle barrels. The invention is a solution to this problem.

SUMMARY OF THE INVENTION

The invention is a method for nitriding and/or nitrocarburizing the internal surfaces within the bore of a rifle barrel to form a hardened surface. The method consists of the steps of attaching a funnel to the end of the rifle barrel and disposing the rifle barrel with the attached funnel in a fluidized bed furnace having a particulate medium fluidized by a vertical flow of reactant gases therethrough. The rifle barrel is disposed in the fluidized bed furnace in a substantially vertical position with the funnel facing downward opposite to the direction of flow of the reactant gases. The method further includes treating the rifle barrel in the fluidized bed with the reactant gases at a predetermined temperature for a period of time predetermined to produce the desired nitrided or nitrocarburized surface within the bore of the rifle barrel. The funnel preferably directs an increased quantity of the reactant gases and the fluidized particulate medium through the bore of the rifle barrel thereby producing excellent nitrided or nitrocarburized surfaces.

The object of the invention is a method for producing excellent nitrided and nitrocarburized surfaces within the bore of a rifle.

Another object of the invention is a method for enhancing the flow of the reactant gases through the bore of the rifle during the formation of the nitrided or nitrocarburized surfaces.

Another object of the invention is a method in which a fluidized bed furnace is used to reduce the processing time and temperature.

Still another object of the invention is a method in which a funnel is placed at the inlet end of the bore of the rifle to increase the quantity of reactant gases and fluidized particulate medium flowing through the bore of the rifle.

Still another object of the invention is to optimize the simultaneous nitriding and nitrocarburizing of the internal and external surfaces of an elongated hollow object in a fluidized bed furnace.

Still another object of the invention is to obtain comparable nitrided or nitrocarburized surfaces on the internal and external surfaces of a cylindrically shaped object in a fluidized bed furnace.

Another object of the invention is a method to produce a rifle barrel having a hardened bore which has a smooth finish, high wear resistance, reduced friction and which is warp resistant.

A final object of the invention is the nitriding and nitrocarburizing of titanium alloys at significantly reduced temperatures and significantly reduced times.

These and other objects of the invention will become more apparent from a reading of the specification in conjunction with the appended drawings.

DETAILED DESCRIPTION OF THE PREFERRED EMBODIMENT

Figure 1:
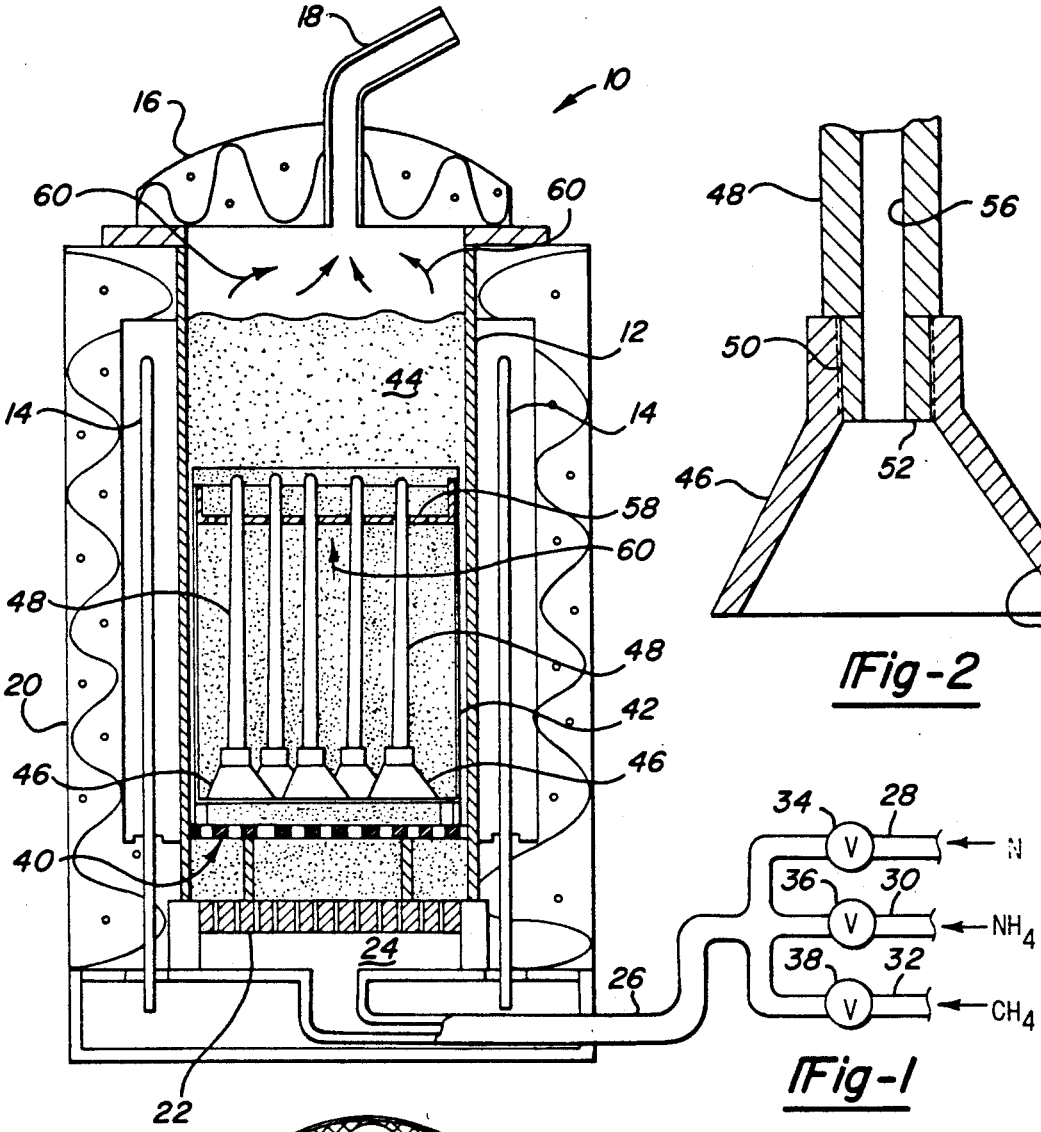
FIG. 1 is a cross-sectional view of a fluidized bed furnace showing the orientation of the rifle barrels and the funnels therein.

The nitriding or nitrocarburizing of a metal gun barrel is conducted in a fluidized bed furnace such as taught by Ross in U.S. Pat. No. 4,461,656 and by G. C. Ikens in the article "Fluidized Bed Furnaces Support Metal Surface Treatments", Manufacturing Engineering, November, 1985. As shown in FIG. 1, a fluidized bed furnace 10 consists of a vertically oriented cylindrically shaped retort 12 which is heated by a plurality of heating elements 14 such as silicon carbide heater elements. The upper end of the retort 12 is enclosed by a swing-away hood 16 having an exhaust manifold 18. The swing-away hood 16 may be lifted and swung to one side of the retort 12 by a mechanism not shown to permit components which are to be treated to be lowered into and removed from the retort 12.

The retort 12 is circumscribed by an insulating shell 20 and is enclosed at the bottom by a porous diffusion plate 22. The lower face of the diffusion plate 22 interfaces a plenum or gas distribution chamber 24 which receives the desired reactant gases via a reactant gas manifold 26. The reactant gas manifold 26 is connected to a plurality of reactant gas sources by a plurality of individual feed lines such as feed lines 28, 30 and 32. Each feed line 28, 30 and 32 has a flow control valve 34, 36 and 38, respectively, which individually controls the volumetric flow rate of each of the reactant gases into the gas distribution chamber 24 and the retort 12. For nitriding a component, the reactant gases may be ammonia ($NH_4$) and nitrogen (N) while for nitrocarburizing the reactant gases may also include natural gas ($CH_4$) as shown.

A porous platform 40 is supported above the diffusion plate 22 and supports a porous component basket 42. The porous component basket is preferably made from a coarse wire mesh having relatively large openings which offer little or no resistance to a fluidized particulate medium 44 to pass therethrough. In normal operation of the fluidized bed furnace, the components to be nitrided or nitrocarburized are loaded into the component basket 42 prior to the component basket being lowered into the furnace. The components may then be lowered into the retort 12 by an overhead hoist or crane (not shown).

The retort 12 is filled or substantially filled with a particulate medium 44 such as very fine sand (SiO) or aluminum oxide ($Al_2O_3$) as is known in the art. Preferably, the particle size of the fluidized particulate medium 44 is approximately 90 grit.

In operation, the flow of the reactant gases is adjusted to have the desired concentration relative to each other and the combined flow rate sufficient to fluidize the particulate medium 44 within the retort 12. The flow of the reactant gases is uniformly distributed by the particles of the fluidized particulate medium 44 enhancing their reaction with the components to be treated. The fluidized particulate medium 44 also significantly enhances the heat transfer between the sides of the retort 12 and the components being treated.

Figure 2:
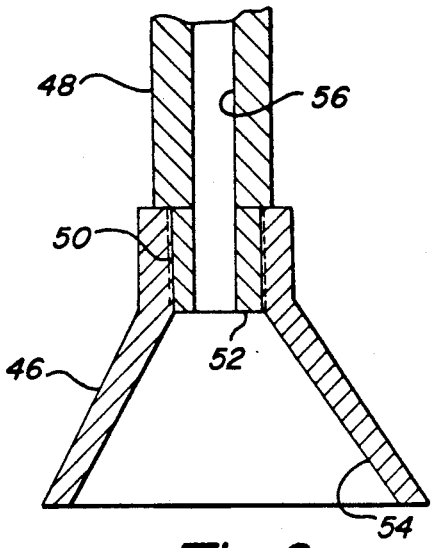
FIG. 2 is a partial cross-sectional view showing the threaded attachment of the funnel to the rifle barrel.

A funnel 46 is attached to the end of each rifle barrel 48 to be nitrided or nitrocarburized. The reduced diameter end of the funnel 46 may have an internal threaded portion 50 which is threaded onto a threaded end 52 of the rifle barrel 48 as shown in FIG. 2. The diameter of an open end 54 of the funnel 46 is larger than the diameter of a bore 56 of the rifle barrel 48. This effectively increases the effective diameter of the bore of the rifle barrel 48.

Figure 3:
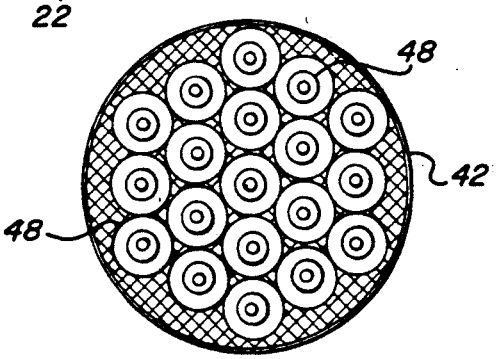
FIG. 3 is a plan view showing the arrangement of the rifle barrels in the component basket prior to being lowered into the fluidized bed furnace.

As shown in FIG. 3, a plurality of rifle barrels 48 are loaded into the component basket with the open ends of the funnels 46 resting on the bottom of the component basket. A support bracket 58 may be suspended from the upper portion of the component basket 42 to maintain the rifle barrels 48 in a substantially vertical position inside the retort 12 which is generally parallel to the direction of flow of the reactant gases. After the rifle barrels are loaded into the component basket 42, the component basket is lowered into the retort as shown in FIG. 1. The level of the fluidized particulate medium is selected to be above the ends of the rifle barrels.

The flow direction of the reactant gases through the retort 12 is from the bottom of the retort 12 towards the swing-away hood 16 and out the exhaust manifold 18 as indicted by arrows 60. The open end of the funnels 46 direct an increased quantity of reactant gases to flow through the bores 56 of the rifle barrels 48. The increased flow of the reactant gases through the bores 56 also increases the quantity of the fluidized particulate medium 44 flowing through the bores 56 of the rifle barrels.

The increased flow of the reactant gases and the fluidized medium significantly enhance the nitriding or nitrocarburizing of the internal surfaces of the bore 56. By proper selection of the diameter of the open end of the funnel 46 and the flow rate of the reactant gases through the retort 12, the nitriding or nitrocarburizing of the external surface of the rifle barrel and the internal surfaces of the bore 56 may be equalized or otherwise optimized for the particular application. It is also to be noted that the action of the fluidized particulate medium 44 flowing through the bores 56 interacts with the surfaces being nitrided or nitrocarburized and produces a smooth hard surface.

The process and apparatus for nitriding or nitrocarburizing in a fluid bed furnace is applicable to ferrous and non-ferrous rifle or gun barrels. The nitriding and nitrocarburizing process described above is not limited to rifle barrels but is equally applicable to other elongated hollow components which have internal surfaces which are shielded or partially shielded by external surfaces of the component.

As shown in the following examples, excellent results were obtained with rifle barrels made from ferrous metals and rifle barrels made from titanium alloys.

EXAMPLE 1

A rifle barrel made from 4150 steel was nitrocarburized in a fluid bed furnace for four hours at a temperature of 950° F. The rifle was mounted in a vertical position and had a funnel attached to its end which faced the direction of flow of the reactant gases from the diffusion plate 22 toward the exhaust manifold 18. The composition of the reactant gases by volume were:

| | |
|---|---|
| Ammonia ($NH_4$) | 45% |
| Natural Gas ($CH_4$) | 45% |
| Nitrogen (N) | 10% |

The result obtained was a rifle barrel in which the bore had a superior epsilon phase nitrocarburized surface. This nitrocarburized surface had a case depth of about 0.003 to 0.006 inches and a 0.001 compound zone. The nitrocarburized rifle barrel exhibited the following characteristics:

1. Increased projectile velocity.
2. The bore had a smooth finish.
3. The bore had reduced friction.
4. The bore had a high wear resistance.
5. The bore's hardness was significantly increased.
6. The rifle barrel exhibited warp resistance even after repeated firings.
7. The bore had improved resistance to corrosion.

EXAMPLE 2

A rifle barrel made from a titanium alloy (Ti6-4 V) was nitrocarburized in a fluidized bed furnace for six hours at a temperature of approximately 1,450° F. The titanium alloy rifle barrel was mounted in a vertical position and had a funnel attached to its end facing in the direction of flow of the reactant gases from the diffusion plate 22 towards the exhaust manifold 18 of the fluidized bed furnace. The composition of the reactant gases by volume was as follows:

| | |
|---|---|
| Ammonia ($NH_4$) | 50% |
| Natural Gas ($CH_4$) | 5% |
| Nitrogen (N) | 45% |

The result obtained was a titanium alloy rifle barrel having a nitrocarburized bore surface. The performance characteristics of the titanium alloy rifle barrel were substantially the same as the characteristics of the ferrous rifle barrel described in Example 1. The bore of the rifle barrel had a gold colored beta phase nitrocarburized surface having a case depth ranging from 0.003 to 0.006 inches and a 0.001 inch compound zone. The primary advantage of the use of the fluidized bed furnace and the funnels at the ends of the titanium alloy rifle barrels is that the processing time to produce the same results in a non-fluidized bed furnace is reduced from 24 hours to 6 hours and the processing temperature is reduced from 1,800° F. to 1,850° F. as taught by the prior art to a temperature range of 1,400° F. to 1,600° F. This reduction in temperature is significant for the treatment of titanium alloy rifle barrels or other titanium alloy components because it is well below the softening temperature of the titanium alloy. Therefore, warping and other deformation of the titanium alloy rifle barrels or other titanium alloy components is significantly reduced and, in most cases, eliminated.

Although both examples given above were for producing nitrocarburizing surfaces, those skilled in the art will recognize that by eliminating natural gas as one of the reactant gases, the resultant hardened surface will be a nitrided surface rather than a nitrocarburized surface. The processing temperature ranges and times for processing the nitrided surfaces are substantially the same as those for processing the nitrocarburized surfaces of Examples 1 and 2.

Both the nitriding and nitrocarburizing of ferrous and titanium alloys in a fluidized bed furnace resulted in significant reductions in processing temperatures and the use of the funnels directing the reactant gases and the fluidized particulate medium into the bore of the rifle barrel significantly reduced the processing times. For nitriding or nitrocarburizing ferrous rifle barrels, the processing temperature may range from 800° F. to 1,200° F. with the processing times being inversely proportional to the processing temperatures. The processing times for ferrous metal rifle barrels ranges from three to eight hours. For nitriding or nitrocarburizing titanium alloys, the processing temperatures may range from 1,300° F. to 1,600° F. with the processing times being inversely proportional to the processing temperature. The processing times for titanium alloy rifle barrels ranges from five to ten hours. As is known in the art, processing temperatures and processing times will also be a function of the specific composition of the material or alloy from which the component is made.

It is not intended that the invention be limited to nitriding or nitrocarburizing rifle or gun barrels but it is equally applicable to producing nitrided and nitrocarburized surfaces on the internal surfaces of other components in which the surfaces to be nitrided or nitrocarburized are internal surfaces which are partially shielded from the reactant gases and the fluidized particulate medium. It is further intended that the process is not limited to the specific ferrous or titanium alloys described in the examples nor the reactant gases or compositions discussed herein. It is recognized that those skilled in the art may amend or make changes within the scope of the process as described herein and set forth in the appended claims.

What is claimed is:

1. A process for hardening the surface of a bore of a rifle barrel comprising the steps of:

attaching a funnel to an end of said rifle barrel;

disposing said rifle barrel with said attached funnel into a fluidized bed furnace having a particulate medium fluidized by a vertical flow of reactant gases therethrough, said rifle barrel being disposed in a vertical position with said funnel facing in the direction of flow of said reactant gases; and treating said rifle barrel in said fluidized bed with said reactant gases at a predetermined temperature for a predetermined period of time to harden said surface of said bore, said funnel directing an increased amount of said reactant gases and said fluidized particulate medium through said bore of said rifle barrel.

2. The process of claim 1, wherein said rifle barrel is made from a ferrous alloy, said reactant gases comprise a mixture of ammonia, natural gas and nitrogen, and said step of treating said rifle barrel produces a hardened nitrocarburized surface on said surface of said bore.

3. The process of claim 1, wherein said particulate medium is selected from the group of granulated materials comprising SiO and $A_2O_3$.

4. The process of claim 1, wherein said rifle barrel is made from a ferrous alloy and said mixture of reactant gases comprise a mixture of ammonia and nitrogen, and wherein said step of treating said rifle barrel comprises the step of heating said rifle barrel in the presence of said mixture of ammonia and nitrogen to a temperature in the range from 800° F. to 1,200° F. for a period of time ranging from three to six hours to produce a hardened nitrided surface on said surface of said bore.

5. The process of claim 1, wherein said rifle barrel is made from a titanium alloy, said reactant gases comprise a mixture comprising approximately equal volumes of ammonia and nitrogen, and wherein said step of treating comprises heating said rifle barrel in the presence of said mixture of ammonia and nitrogen at a temperature in the range from 1,400° F. to 1,600° F. for a time ranging from five to eight hours to produce a hardened nitrided surface on said surface of said bore.

6. The method of claim 1, wherein said rifle barrel is made from a titanium alloy and said reactant gases comprise a mixture of ammonia, natural gas and nitrogen, said step of treating comprises the step of heating said rifle barrel to a temperature ranging from 1,400° F. to 1,600° F. for a time ranging from five to ten hours to produce a hardened nitrocarburized surface on said surface of said bore.

7. The method of claim 1, wherein said mixture of ammonia, natural gas, and nitrogen comprises by weight approximately 50% ammonia, 45% nitrogen and 5% natural gas and wherein said step of treating said rifle barrel comprises the step of heating said rifle barrel to a temperature of approximately 1,450° F. for approximately six hours.

8. The process of claim 2, wherein said step of treating said rifle barrel comprises the step of heating said rifle barrel in said fluidized particulate medium at a temperature in the range from 800° F. to 1,200° F. for a time from three to six hours.

9. The process of claim 2, wherein said step of treating said rifle barrel comprises the step of heating said rifle barrel in said fluidized particulate medium at a temperature of approximately 950° F. for approximately four hours.

10. The process of claim 4, wherein said mixture of ammonia and nitrogen comprises approximately equal volumes of ammonia and nitrogen.

11. The process of claim 8, wherein said mixture of reactant gases comprises a mixture, containing by volume, approximately 45% ammonia, approximately 45% natural gas, and approximately 10% nitrogen.

12. The process of claim 9, wherein said reactant gas comprises a mixture containing by volume, approximately 45% ammonia, 45% natural gas and 10% nitrogen.

13. A method for nitriding an inner surface of an elongated hollow component having an inlet aperture at one end thereof comprising the steps of:

attaching a funnel to said inlet aperture of said elongated hollow component to increase the effective area of said inlet aperture;

disposing said elongated hollow component in a fluidized bed furnace having a particulate medium fluidized by a flow of a mixture of ammonia and nitrogen therethrough, said elongated hollow component being disposed in said fluidized bed furnace parallel to said flow of said mixture of ammonia and nitrogen and with said funnel facing said flow of said mixture of ammonia and nitrogen; and heating said elongated hollow component in said fluidized bed furnace to a predetermined temperature for a predetermined period of time to nitride said inner surface of said elongated hollow component.

14. The method of claim 13, wherein said elongated hollow component is made from a ferrous alloy, said step of heating comprises the step of heating said elongated hollow component to a temperature ranging from 800° F. to 1,200° F. for a time ranging from three to eight hours.

15. The method of claim 13, wherein said elongated hollow component is made from a ferrous alloy, said step of heating comprises the step of heating said elongated hollow component at a temperature of approximately 950° F. for approximately four hours in said fluidized bed furnace.

16. The method of claim 13, wherein said elongated hollow component is made from a titanium alloy, said step of heating comprises the step of heating said titanium alloy elongated hollow component to a temperature ranging from 1,400° F. to 1,600° F. for a period of time ranging from five to ten hours in said fluidized bed furnace.

17. The method of claim 13, wherein said elongated hollow component is made from titanium alloy, said step of heating comprises heating said titanium alloy elongated hollow component to a temperature of approximately 1,450° F. for approximately six hours in said fluidized bed furnace.

18. A method for nitrocarburizing an inner surface of an elongated hollow component having an inlet aperture at one end thereof comprising the steps of:

attaching a funnel to said inlet aperture of said elongated hollow component to increase the effective size of said inlet aperture, inserting said elongated hollow component in a fluidized bed furnace having a particulate medium fluidized by a flow of a mixture of reactant gases comprising ammonia, natural gas and nitrogen therethrough, said elongated hollow component being disposed in said fluidized bed furnace parallel to said flow of said mixture of reactant gases with said funnel facing said flow of said mixture of reactant gases;

heating said elongated hollow component in said fluidized bed furnace to a predetermined temperature for a predetermined period of time to nitrocarburize said inner surface of said elongated hollow component.

19. The method of claim 18, wherein said elongated hollow component is made from a ferrous alloy, said step of heating comprises the step of heating said elongated hollow component in said fluidized bed furnace to a temperature ranging from 800° F. to 1,200° F. for a period of time ranging from three to ten hours.

20. The method of claim 18, wherein said elongated hollow component is made from a ferrous alloy, said step of heating comprises the step of heating said elongated hollow component in said fluidized bed furnace to a temperature of approximately 950° F. for approximately four hours.

21. The method of claim 18, wherein said elongated hollow component is made from a titanium alloy, said step of heating comprises the step of heating said titanium alloy elongated hollow component to a temperature ranging from 1,400° F. to 1,600° F. for a period of time ranging from five to ten hours.

22. The method of claim 18, wherein said elongated hollow component is made from a titanium alloy, said step of heating comprises the step of heating said titanium alloy elongated hollow component at approximately 1,450° F. for approximately six hours.

23. The method of claim 20, wherein said mixture of reactant gases comprises by volume approximately 45% ammonia, 45% natural gas and 10% nitrogen.

24. The method of claim 23, wherein said mixture of reactant gases comprise by volume approximately 50% ammonia, 45% nitrogen and 5% natural gas.

* * * * *

UNITED STATES PATENT AND TRADEMARK OFFICE

CERTIFICATE OF CORRECTION

PATENT NO. : 5,039,357

DATED : August 13, 1991

INVENTOR(S) : Epler et al

It is certified that error appears in the above-identified patent and that said Letters Patent is hereby corrected as shown below:

Column 4, line 6, delete "indicted" and insert ---- indicated ----.

Column 6, line 42, delete "mixture of".

Column 6, line 67, delete "1" and insert ---- 6 ----.

Column 7, line 23, delete "gas" and insert ---- gases ----.

Column 8, line 16, delete the comma "," and insert ---- ; ----.

Column 8, line 25, after ";" insert ---- and ----.

Column 8, line 57, delete "23" and insert ---- 22 ----.

In the Abstract

Line 3, delete "of"; (2nd occurrence)

Signed and Sealed this

Ninth Day of March, 1993

*Attest:*

STEPHEN G. KUNIN

*Attesting Officer*

*Acting Commissioner of Patents and Trademarks*